United States Patent [19]

Guettinger

[11] Patent Number: 4,789,315

[45] Date of Patent: Dec. 6, 1988

[54] POSITIVE DISPLACEMENT MACHINE, MORE PARTICULARLY PUMP, AND METHOD FOR FABRICATING SUCH PUMP

[75] Inventor: Kurt Guettinger, Murten, Switzerland

[73] Assignee: Gutag Innovations AG, Murten, Switzerland

[21] Appl. No.: 928,177

[22] PCT Filed: Feb. 21, 1986

[86] PCT No.: PCT/CH86/00023

§ 371 Date: Dec. 1, 1986

§ 102(e) Date: Dec. 1, 1986

[87] PCT Pub. No.: WO86/05241

PCT Pub. Date: Sep. 12, 1986

[30] Foreign Application Priority Data

Feb. 27, 1985 [CH] Switzerland ..... 894/85

[51] Int. Cl.[4] ..... F04C 2/04; F04C 11/00; F04C 15/00

[52] U.S. Cl. ..... 418/56; 418/57; 418/58; 418/59

[58] Field of Search ..... 418/56, 58, 59, 61 R, 418/182, 57

[56] References Cited

U.S. PATENT DOCUMENTS

| | | | |
|---|---|---|---|
| 1,229,676 | 6/1917 | Tice | 418/59 |
| 2,112,890 | 4/1938 | Gunn . | |
| 2,856,860 | 10/1958 | Roth . | |
| 3,097,610 | 7/1963 | Swanson | 418/182 |
| 3,551,079 | 12/1970 | Brundage . | |

FOREIGN PATENT DOCUMENTS

| | | | |
|---|---|---|---|
| 0053868 | 6/1982 | European Pat. Off. . | |
| 0061560 | 10/1982 | European Pat. Off. . | |
| 62264 | 5/1892 | Fed. Rep. of Germany . | |
| 1962109 | 7/1970 | Fed. Rep. of Germany . | |
| 2222168 | 11/1972 | Fed. Rep. of Germany . | |
| 2257398 | 6/1973 | Fed. Rep. of Germany . | |
| 2230773 | 6/1973 | Fed. Rep. of Germany . | |
| 2509536 | 9/1976 | Fed. Rep. of Germany | 418/57 |
| 2911655 | 10/1980 | Fed. Rep. of Germany . | |
| 3106314 | 9/1982 | Fed. Rep. of Germany . | |
| 7156 | 5/1907 | France . | |
| 428218 | 8/1911 | France . | |
| 825643 | 3/1938 | France . | |
| 1095539 | 6/1955 | France . | |
| 1197750 | 12/1959 | France . | |
| 630656 | 12/1987 | France . | |
| 59-12188 | 1/1984 | Japan | 418/58 |
| 59-147893 | 8/1984 | Japan | 418/59 |
| 476212 | 9/1969 | Switzerland . | |
| 17672 | of 1910 | United Kingdom | 418/182 |
| 154261 | 12/1920 | United Kingdom . | |
| 290251 | 4/1929 | United Kingdom | 418/59 |
| 1013263 | 12/1965 | United Kingdom . | |

*Primary Examiner*—John J. Vrablik

*Attorney, Agent, or Firm*—Marks Murase & White

[57] ABSTRACT

The machine comprises two plate-like supports (9, 12) each provided with a crown of displacement blades (10), respectively displacement chambers (11), engaged into each other, and displaceable into a relative circular translation motion. The drive is implemented by a gear (7–9) at the center of the supports (9, 12), which exerts a force ($F_N$) on one of the supports (9) at a radially displaceable position, said force presenting a radial component ($F_R$) and a tangential component ($F_T$). The direction of the force and the arrangement of the chambers (11) are so selected as to provide for a predetermined static position of the blades (10) in the chambers (11) independently of the wear. Optimum operation conditions are thus obtained with simple design and fabrication. For producing said pump, the plate-like supports are lapped pair-wise when they are in the state of blanks in conditions similar to the operation conditions and are then mounted in the machine.

21 Claims, 5 Drawing Sheets

FIG. 2
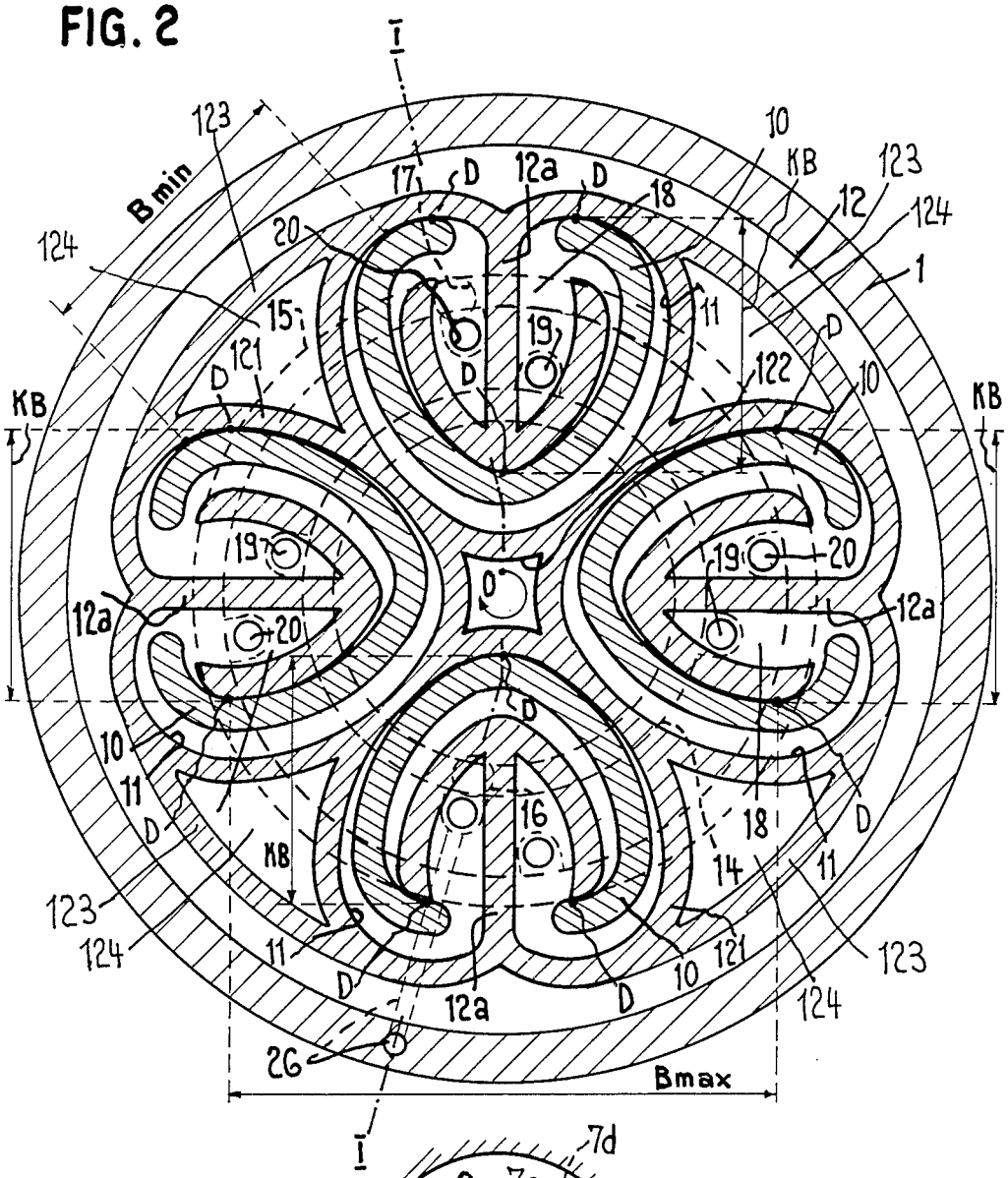
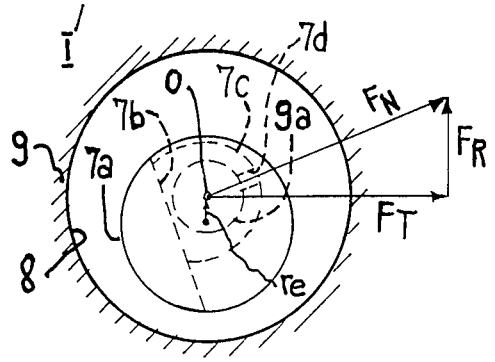
FIG. 4

POSITIVE DISPLACEMENT MACHINE, MORE PARTICULARLY PUMP, AND METHOD FOR FABRICATING SUCH PUMP

BACKGROUND OF THE INVENTION

1. Field of the Invention

The present invention relates to positive displacement pumps, more particularly a positive displacement pump with displacement chambers, and displacement vanes, such that the displacement chambers and the displacement vanes establish a cyclical relative motion.

2. Related Art

Pumps of the general category of the present invention are known for example from German Pat. No. DT 22 30 773 to W. Gramm. However, it has been discovered that it is practically impossible to manufacture displacement chambers and displacement vanes with enough precision to ensure that, when driven with a rigid stroke, or a precise circular motion, the displacement vanes always follow closely to the walls of the displacement chambers thereby avoiding excessive strains or leaks. Further, with prior art pumps additional guide means are required to maintain the stability of the driven part in its desired position. Finally, the displacement chambers and displacement vanes of prior pumps are of such a shape that they interlock only over a section of about 270° of the relative motion. It is therefore necessary to connect at least two of the displacement chambers in series with overlapping displacement regions in order to achieve a consistent displacement without leaks.

SUMMARY OF THE INVENTION

It is an object of the present invention to provide a pump as well as a process for manufacturing a pump which avoids all the afore-mentioned disadvantages. The pump is characterized in that there is provided a common, central drive for producing relative motion between displacement chambers and their respective displacement vanes; the drive being capable of transmitting from a driving shaft, through at least one radial adaptable element, a driving force with a definite radial and tangential component to a support of the displacement chamber or displacement vane. The displacement chambers and vanes are each arranged in a crown encircling the drive. The displacement chambers and the displacement vanes each comprise an outer and inner surface of tightness, both surfaces extending over at least 360° and, during cyclical relative motion, being displaced relative to each other in a tight way on both sides of the displacement vane over the full cycle of motion of each displacement chamber, such that independently of the precise form and size of the displacement chambers and vanes, a sure, tight, mutual close fitting of these chambers is guaranteed while realizing the mutual, close fitting of these chambers is in a determined relative position.

The radial adaptable element which produces a driving force with a radial and a tangential component acts on the driven support in such a way that the displacement vanes and chambers are maintained in a tight relationship. Irregularities of the relative motion, that is differences of this motion from circular, are equalized by the radial adjustable element which acts like a spring or like a friction force, but not like a force transferred by a form. The direction of the driving force may be chosen such that the driven support is always firmly supported in a determined position by the opposite contacting surfaces of the displacement vanes. The chambers are arranged in an external border so that the support cannot tip.

The flexible drive which permits a slightly out of circular relative motion permits a correspondingly greater liberty in the design of the form of the displacement chambers and vanes, more particularly of their configuration, such that each chamber remains tight over 360° of the relative motion. In this manner, each chamber may directly contribute to the displacement without being connected in series with another chamber. Preferably, the drive comprises a driver secured on a driving shaft. The driver acts with a driving surface inclined towards the radial direction on a socket which is mounted on a bolt of the holder to be driven. This arrangement has the advantage that in case of wear the direction of the driving force changes in such a way that the radial component of the force advantageously decreases slightly.

The above described combination of properties of the pump, and of its parts lends itself to advantageous production as detailed below. Using an appropriate, adjustable drive the displacement chambers and vanes lie within one another in a predetermined, stable position which permits the lapping of the active parts of the pump against each other. During manufacture, the drive is preferably alternately reversed in order to work off inaccuracies of the chamber form thereby avoiding deviations in the form of one chamber from being replicated in all other chambers. A large series of parts may be lapped together in a special device and then washed in pairs and mounted in a machine, i.e. a pump.

In the machines of the above described kind, problems may arise with respect to the gap between both adjacent supports for the displacement vane or vanes, and the displacement chamber or chambers. On the one hand the gap should be as narrow as possible in order to avoid a situation wherein the medium under pressure escapes from the displacement chamber as a leak through the gap. On the other hand, the film of lubricating liquid between the front surfaces lying one upon the other of both supports should not be too thin in order to avoid excessive losses by friction or even a mutual sticking and locking of both supports. It is very difficult to fix beforehand optimum conditions because the shearing force acting between the supports depends on very many factors, more particularly the rheological properties of the liquid, the roughness of the surfaces lying one upon the other, the properties of the material of the supports, the relative speed of the pressing force and the reticulation.

It is also an object of the present invention to provide a simple, optimum, practical solution to the problems mentioned above. To this end, pressure may be built up in an intermediate pressure chamber designated to receive medium leaking through the packing gap between the supports. This pressure urges the supports against each other such that optimum operating conditions are achieved. Preferably, a return channel having a flow under pressure, determined by the streaming resistance, may be provided between the intermediate pressure chamber and the suction side or low pressure side of the pump. The streaming resistance may be dimensioned in order to achieve an optimum of efficiency. A corresponding optimization of the pressing force between the supports, and of the conditions in the packing gap between both supports is also possible when the full operating pressure acts only on a appropriate part of one, or as the case may be, both supports. The easy starting of the pump permits use of a drive motor having a relatively low power.

It has been found that prior art pumps of the present kind have a tendency to produce back coupling oscillations to an extent which leads to the sticking and then to a sudden breaking loose of the supports. The present invention also relates to measures for stabilizing the working manner of the machine, and for avoiding oscillations.

The invention will be described further by way of an example of execution of a positive displacement pump and a variant thereof illustrated in the drawings.

BRIEF DESCRIPTION OF THE DRAWINGS

FIG. 2 illustrates a section through the pump along the line II—II of FIG. 1, FIG. 4 illustrates the working manner of the drive of the pump.

DETAILED DESCRIPTION OF PREFERRED EXEMPLARY EMBODIMENTS

Figure 1:
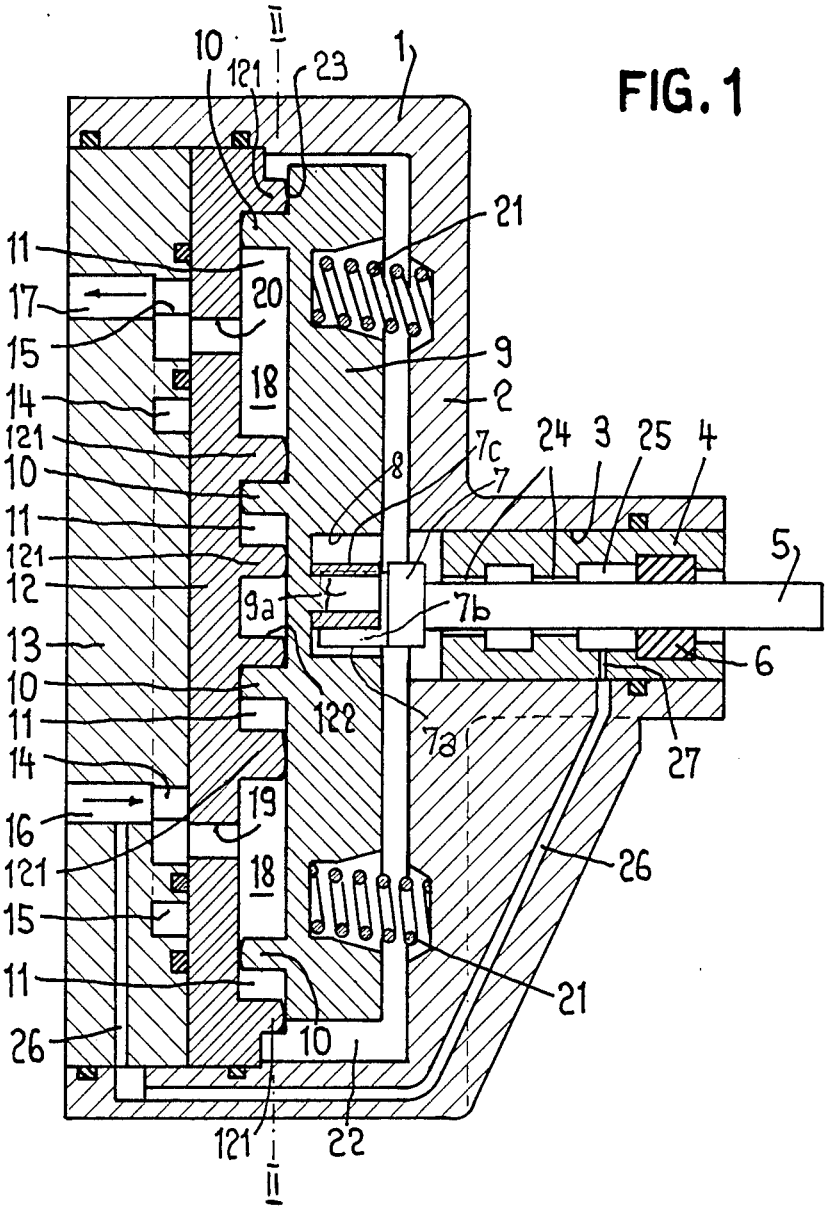
FIG. 1 illustrates an axial cross section through the pump along the line I—I of FIG. 2.

The pump according to FIGS. 1 and 2 comprises a housing with a casing 1 as well as a bearing flange 2 with an opening 3 for a bearing. A bearing bushing 4 supporting a driving shaft 5 is inserted in the opening 3. At the external end of the bearing bushing 4 is inserted a packing ring 6 between the bearing bushing 4 and the shaft 5. The internal end 7 of the shaft 5 has a greater diameter and it is milled so that a flat catching surface 7*b* is provided at a projecting segment 7*a*. The segment 7*a* engages in a cylindrical recess 8 of a plate shaped support 9 where its catching surface 7*b* is supported on a flat place of a bushing 7*c*. The bushing 7*c* is supported by a stud 9*a* of the support 9. It comprises a slot 7*d* which enhances intensive greasing and cooling between the bushing 7*c* and the stud 9*a*. The operation of this drive will be explained later on with respect to FIG. 4.

Figure 5:
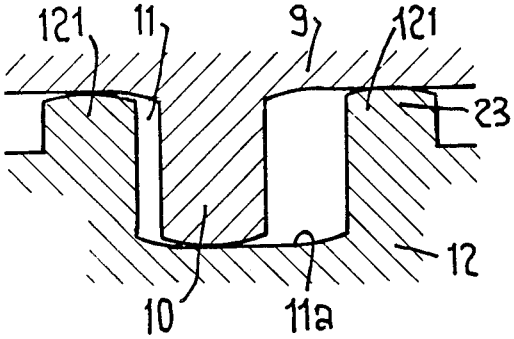
FIG. 5 illustrates a preferred form of one section of a displacement vane.
Figure 6:
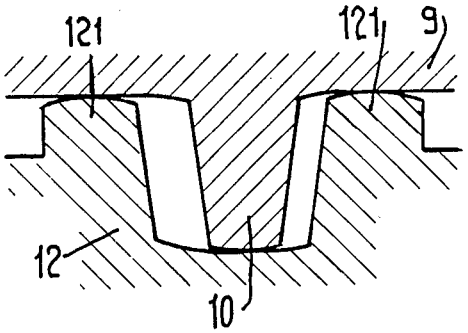
FIG. 6 illustrates a further preferred form of execution of a displacement vane and a displacement chamber.

Driving is possible in both directions of rotation. The plate shaped support 9 consists of a piece with rib shaped displacement vanes 10 which engage in groove shaped displacement chambers 11 which are provided in a further place shaped support 12. The displacement chambers 11 are encompassed by raised ribs 121 of the support 12. A recess 122 exists inside of the ribs in the center of the support 12. As shown in FIGS. 1, 5 and 6, the front faces of the ribs 121, as well as of the displacement vanes 10, are slightly convex shaped in order to avoid friction between the parts 9 and 12. The width of the ribs 121 is preferably smaller than the double eccentricity of the movement of the support 9, which enhances effective and rapid removal of solid matter which deposits between the parts 9 and 12. As explained later, both supports 9 and 12 may consist of simple parts of plastic. The back wall of the pump is formed by a connection plate 13. The connecting plate 13 comprises internal connecting channels 14 and 15 which connect inlet channels 19 and outlet channels 20 of the displacement chambers 11 to an inlet opening 16 and an outlet opening 17, respectively.

Figure 3:
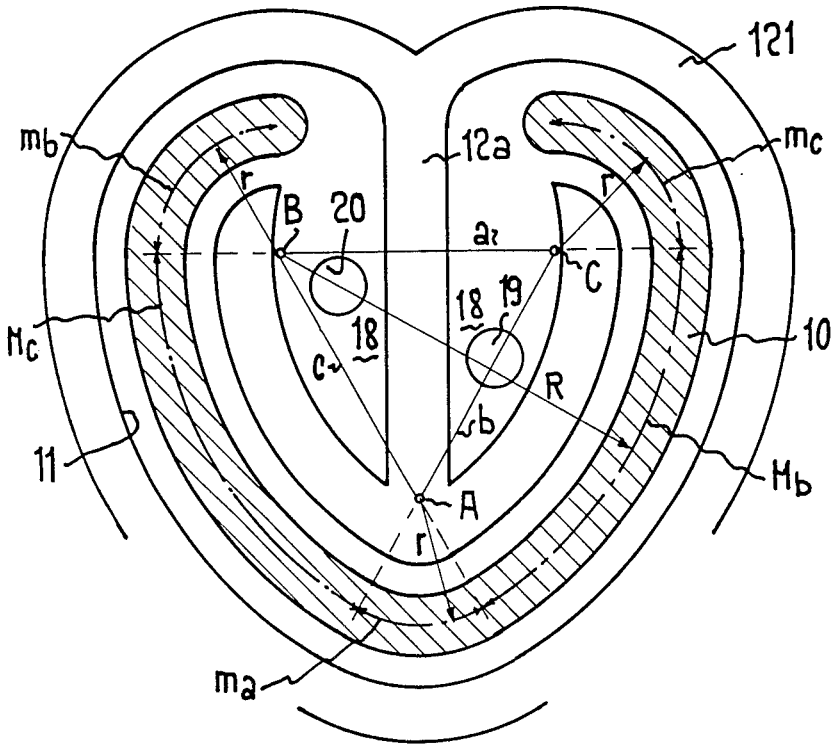
FIG. 3 illustrates a preferred geometrical condition of a displacement chamber and a displacement vane.

FIG. 2 shows the particular form and arrangement of the displacement chambers and displacement vanes while FIG. 3 shows with more precision the geometrical form of these displacement chambers and displacement vanes. The support 9 is provided with four displacement vanes 10 in a symmetrical central arrangement, these displacement vanes engaging in four corresponding displacement chambers 11 centrally symmetrically arranged in the plate shaped support 12. The symmetric arrangement of each of the four displacement vanes and displacement chambers of triangular of heart-shaped configuration provides not only a very favorable utilization of space on the supports 9 and 12, but also provides a high stability of the position of the movable support 9 when driven by the point-shaped or line-shaped rest of the catching roll 7 in the recess 8. First the configuration of the displacement vanes and displacement chambers illustrated in FIG. 3 will be explained in detail. The geometric configuration of these chambers is an isoceles triangle with sides a, b and c and apexes A, B and C. FIG. 3 shows a center line of symmetry M of the displacement vane and of the associated displacement chamber. The line of symmetry M is composed of two long sections Mb and Mc as well as three shorter sections ma, mb and mc. The sections Mb and Mc each have a great radius of curvature R and centers of curvature B and C, respectively. The shorter sections ma, mb and mc each have a small radius of curvature r and centers of curvature A, B and C, respectively. The center lines of the end parts above the sections mb and mc can be viewed as having a great radius of curvature with the center of curvature A or as having a small radius of curvature with the centers of curvature B and C, respectively. Alternatively a configuration lying in between these extremes may be used, as will be explained in more detail. The flanks of each displacement vane 10 and each displacement chamber 11 have a corresponding configuration, that is with great or small radii and corresponding centers of curvature A, B and C as shown in FIG. 3. It is essential that at the transitions between the parts with a small radius of curvature and the parts with a great radius of curvature, no discontinuities are present, i.e. the tangents at the adjacent curved parts must be continuous. It is this design criterion which ensures that the displacement vanes, when executing a cyclical circular relative motion in the displacement chambers, tightly contact two points of the walls of the displacement chambers. The contact points move for each cyclical motion continuously along the walls of the displacement chambers. The size and the direction of this cyclical translational circular motion of the support 9 and its displacement vane 10 is indicated in FIG. 2 by the arrow in the center. This motion has, in accordance with FIG. 2, an upper start position for which the displacement vane 10 fits closely at the top in the upper displacement chamber, symmetrically on both sides, establishing two points of tight contact. From this position, the four displacement vanes start to move horizontally to the right by the translational rotary motion. As illustrated, for all points of contact designated D between each displacement vane and the associated displacement chamber, a free horizontal motion to the right along the tangent (or the tangential plane) is possible at the wall of the displacement chamber at the place D. The contact points then travel in correspondence with the cyclical, translation, rotary motion along the walls of the displacement chambers. The ends of the triangular or heart-shaped displacement chambers are separated from one another by a wall 12*a* and these ends communicate with protrusions 18 of the chambers which are directed inwards and are inwardly tapered. In each of these chamber protrusions 18 is an inlet opening 19 which traverses the support 12 and an outlet opening 20. The inlet openings 19 are arranged on a radius shorter than the radius of the outlet openings 20. As shown more particularly in FIG. 1, all inlet openings 19 are connected together and with the inlet 16 of the pump through the annular channel 14. Correspondingly, all, outlet openings 20 are connected with the annular channel 15 and through the latter with the outlet of the pump. The four displacement chambers are therefore connected in parallel and they operate in parallel which has a positive effect on the pulsation of the entire conveyance.

As shown in FIG. 1, the support 9 is pressed against the support 12 with a determined pressure by means of helical springs 21 which are supported at one end in recesses of the support 9 and at another end in recesses of the bearing flange 2. The support 9 is freely movable in an intermediate pressure chamber 22. In the intermediate pressure chamber or compensation chamber 22 and during the operation of the pump, a part of the displaced medium comes out through the gap 23 between the front faces lying one against the other of the supports 9 and 12, as well as through a central opening of the support 9 under the pressure which builds up in the displacement chambers 11 and accumulates in the intermediate pressure chamber 22 which fills up with this medium. From this intermediate pressure chamber 22, the medium may come out through the annular gap 24 between the bearing bushing 4 and the crankshaft 5 outwards in the annular space 25 which is closed by the packing 6. From there, the medium may flow back to the pump inlet 16, that is to the suction side, through a channel 26 which may comprise an obturator 27. The channel 26 may consist of a small tube. It has been found that the correct design of the pressure produced by the springs 21 is an essential condition for a stable operation of the pump. This pressure must be for example of ¼ to ½ of the total pressure, but it must be so designed that the driving motor can start after stops.

As already mentioned, the drive of the support 9 consists of a simple mechanism comprising the shaft 5 which is set into rotation, of its catching segment 7*a*, the bushing 7*c* and the stud 9*a*. This is illustrated in greater detail in FIG. 4. It is assumed that the support 9 is in the upper symmetrical position, that is the axis of the cylindrical recess of the stud 9*a* is in the point 0 indicated in FIG. 2 and that during a cyclical motion this axis moves along a circle of radius re. The support 9 may therefore execute an eccentric translational motion with the radius of eccentricity re with respect to the axis of the shaft 5. The catching surface 7*b* of the segment 7*a* is inclined of e.g. 20° with respect to the connecting line between the shaft 5 and the stud 9*a*. Under the assumption that the friction is negligible between the surfaces lying one upon the other of the segment 7*a* and the bushing 7*c* on the one hand and between the bore of this bushing and the stud 9*a* on the other hand, the effective acting force $F_N$ is perpendicular to the surface 7*b* as shown in FIG. 4. This force may be resolved into a tangential force $F_T$ directed in the instantaneous direction of motion of the support 9 and in a radial force $F_R$ acting perpendicularly to the tangential force $F_T$. The most important tangential force $F_T$ in the illustrated condition takes along the support 9 in the tangential or peripheral direction and causes the cyclical translational circular motion of the support 9 and of its displacement vanes 10. The radial force $F_R$ causes a safe seating of the displacement vanes in the displacement chambers 11. It may be shown and confirmed by experiments that in the illustrated arrangement and configuration of the displacement vanes and chambers, relative few resulting hydrostatic pressure acts in the radial direction on the support 9. The radial component of the force $F_N$ has the effect of putting the displacement vanes radially outwards against the displacement chambers. This produces the necessary stability of the movement in that the instantaneous position of the support 9 and of its displacement vanes is always stable with respect to the support 12, and displacement chamber 11. This is shown in FIG. 2 for two particular positions. In the illustrated position, the radial component $F_R$ of the force acts perpendicularly towards the top as shown in FIG. 4 for the corresponding position. The two upper positions of tight contact D in the horizontally oriented chambers are at a maximum ground distance $B_{max}$. After a rotation of 45° this ground distance becomes a minimum $B_{min}$ as shown in the left part at the top of FIG. 2. In this way, the illustrated arrangement permits not only a good economy of the space at disposal but leads also to a stabilization of the movement thus permitting a very simple drive. For the remaining, this drive acts practically elastically, and self adjusting in each direction so that the above mentioned optimum conditions are always fulfilled even when a certain wear has taken place. Any wear in the displacement chamber and at the displacement vanes has the effect that the support 9 is slightly displaced outwards, its stud 9*a* describing a circular motion of a slightly greater diameter. In this case, the bushing is slightly displaced outwards on the catching surface 7*b*. The driving conditions more particularly the direction of the force $F_N$ changes only very slightly. This depends on the fact that the flat supporting surfaces of the segment 7*a* and of the bushing 7*c* are practically not submitted to wear. For the remaining, the wear in the drive itself may have the effect that the bore of the bushing 7*c* at its position which is the nearest to the catching surface 7*b* is slightly worked off but also the place so used up has a radius corresponding to the uniformly slightly used up stud 9*a* so that a good bearing and transmission of the force is always ensured.

The proper pump effect of the illustrated pump should not necessitate any exhaustive explanation. As mentioned above, the displacement vane moves at first horizontally to the right in the displacement chamber shown at the top of FIG. 2. After a quarter of a turn it reaches the position shown in the displacement chamber on the left of FIG. 2. One sees that during this movement the volume between the outer surface of the displacement vane 10 and the outer surface of the displacement chamber 11 has decreased and that the medium is displaced towards the outlet opening 20. To the contrary, the volume between the inner surface of the displacement vane and the opposite surface of the displacement chamber on the inlet side has increased strongly so that at this place the medium is sucked in through the inlet opening 19. After a half turn, one reaches the position indicated at the bottom of FIG. 2. In this position, the volume inside the displacement vane has reached a maximum value while the volume at the outside of the displacement vane has reached a minimum. By the next rotation to the relative position of the displacement vane in the displacement chamber as illustrated to the right in FIG. 2, the medium is displaced at the inner side of the displacement vane to the outlet while it is sucked in at the outside of the displacement vane.

Experiments have shown that with this form of displacement vanes and displacement chambers, a relatively continuous conveyance of the medium with little pulsation takes place from the inlet to the outlet in each individual chamber.

Practical limits are set to the realization in that the ends of the channel like displacement chambers must obviously be separated by intermediate walls 12*a* which leads to a corresponding great mutual distance of the ends of the displacement vanes. As mentioned it is possible however to obtain very little pulsation by means of the illustrated configuration.

With an optimum configuration and connection in parallel of the four displacement chambers, one obtains pulsations of about 1% of the quantity conveyed. A certain pulsation which is smaller than the leakage and which affects the latter is even desired in order to wash abrasion parts in the capillary gap between the front faces of the supports 9 and 12 and for ensuring that the gap filled with conveyed medium becomes not too small in order to avoid the very high shearing forces which would otherwise take place.

As already mentioned, the illustrated configuration and arrangement of the displacement chambers and vanes permits a very good economy of space or, in other words, a high specific quantity conveyed and power of the pump. FIG. 2 shows the effective widths of the piston which are designated by KB. The total effective width of the pistons is greater than the diameter of a circle encircling the displacement chambers.

Figure 10:
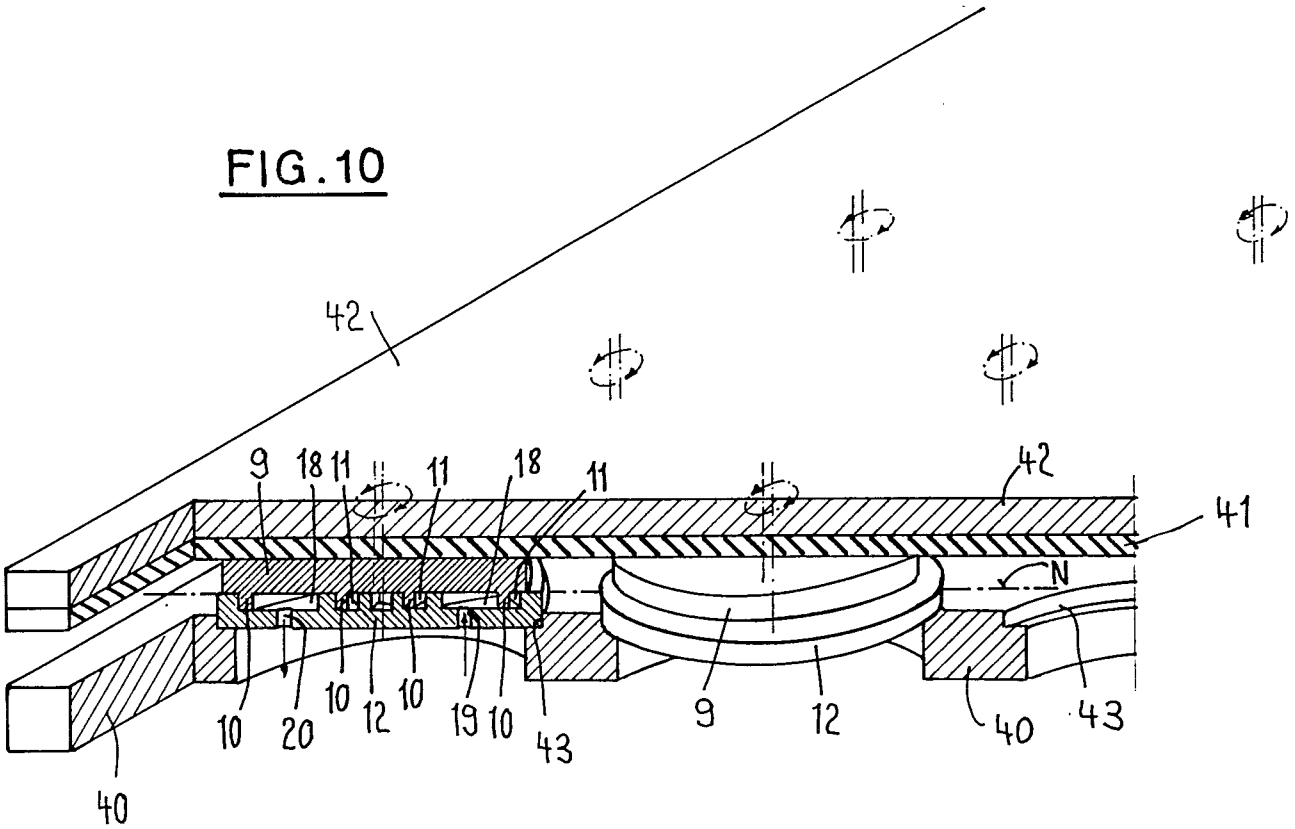
FIG. 10 illustrates a device for fine machining.

The preceding described conception of the pump, more particularly of the kind of the elastic, and the self adjustable drive permits also a manufacture at low price which leads however to a product capable of satisfying the highest requirements. The basic idea consists in that the two supports 9 and 12 with the displacement vanes 10 and displacement chambers 11 may be produced from inexpensive materials, more particularly from plastic parts, in that these parts are put together and driven like in the pump with a grinding material or lapping material in order to give them the final shape and then to wash and to assemble them into the machine. Comprehensive experiments have shown that in this way, starting from relatively imprecise parts 9 and 12, it is possible to achieve very precise final forms which fulfill all conditions with respect to the tightness at eight places between the conveying vanes and the conveying chambers. At the same time, the pump exhibits only minimal pulsation and runs quietly. However, the condition for a successful machining of the parts in this manner is that the parts 9 and 12 consist of materials which are the same with respect to moisture expansion, temperature extension coefficient and abrasion properties. Preferably, one uses the same materials for both parts, more particularly appropriate synthetic materials. Experiments have shown that for lapping the synthetic plastic material parts 9 and 12 of Araldit (trademark), machining during about half an hour is necessary, until tight contact between the displacement vanes and displacement chambers is achieved. After the lapping of the parts with a medium comprising a grinding or lapping material, the parts are washed in a clean medium and assembled by pairs into the pump. Altogether one obtains the essential advantage that it is possible to start from relatively imprecise machined parts. The parts are preferably lapped by reversing alternately the direction of the drive in order to avoid asymmetry of the fine machining. FIG. 10 shows schematically a part of a lapping device of pairs of parts 9 and 12 in the above indicated meaning. A pluraity of pairs of parts 9 and 12 are arranged between a lower, fixed plate 40 and the layer of elastic gum 41 of an upper plate 42 whereby the parts 12 are inserted in holding recesses 43 of the lower part and held in the latter practically without any play while the upper parts 9 are pressed against the layer of elastic gum of the upper plate. During the machining, the plates lie in a bath of lapping medium the level of which reaching about to the indicated height N. The upper plate 12 can be set in a rotary translation motion in any direction whatsoever as indicated by arrows in FIG. 10, by means of an eccentric or crank drive not represented. In operation, the upper plate 42 executes a translational circular motion the radius of which is greater than the one which is necessary to lap the parts whereby the differences of the movements between the plate 42 and the parts 9 driven by it through the layer of elastic gum 41 are absorbed by this layer. The drive of the plate 42 may consist of a unique rigid eccentric gear located in its center. When the installation according to FIG. 10 is in service, lapping liquid is sucked in through the inlet channels 19 of the parts 12, pumped and rejected through the outlet channels 20.

As indicated in the introduction, the above described pump offers particularly advantageous possibilities of an optimum harmonization of all factors in the development of pumps for determined conveying capacity and mediums. One proceeds in that an experimental pump, the supports of which are lapped in the above described manner, is mounted in an experimental construction which permits to measure at the same time the manometric pressure, the pressure in the intermediate chamber 22, the quantity conveyed and with it the efficiency, and whereby the backflow from the intermediate chamber 22 to the inlet of the pump may be adjusted with precision by means of an adjustable obturator. In this experimental device, with the pump in operation and nominal pressure, the adjustable obturator is regulated until the highest efficiency is achieved. This highest efficiency appears for a well determined ratio of the leakflow and pressure in the intermediate chamber 22 such that then optimum conditions appear with respect to the backflow and liquid lubrification, and frictional resistance in the gap 23 between the supports 9 and 12. All the pumps manufactured in series are then dimensioned to this optimum backflow of 1% to 3% in that the backflow resistance in the bearing gap 24 is dimensioned correspondingly or in that a corresponding obturator 27 is mounted. In order to give an idea of the order of magnitudes, it is mentioned that the pressure in the intermediate chamber 22 is for example about the average of the pressures at the inlet and the outlet of the pump. After having described the basic construction, the manufacture and the development of the pumps, one discuss a few variants and special aspects of the invention.

A compromise between the necessity of achieving a good tightness and the necessity to avoid a high friction is to be found not only at the contacting surface, and in the gap 23 between the supports 9 and 12 but also between the front faces of the displacement vanes 10 and the opposite lying ground faces of the displacement chambers 11. Experiments have shown that completely flat surface are not favorable. It is better to realize a final form as shown in FIG. 6. This means that the front faces of the displacement vanes should be slightly convex such that there exists practically only a contact along a line between these front faces and the ground face 11*a* of the displacement chambers 11. This form may be obtained automatically during the above described fine machining with a grinding or a lapping medium, in that the displacement vanes 10 are slightly deformed during the lapping with alternately reversed direction of rotation so that the sides are slightly more worked off. The convex form may also be present in the blank.

As shown in FIG. 6, the profile of the displacement vanes 10 and displacement chambers 11 is slightly trapezoidal with rounded edges in order to achieve a better removing from the press or the injection tools.

Figure 7:
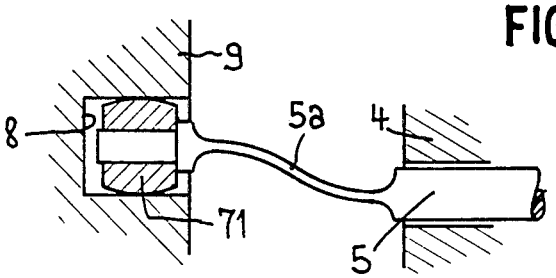
FIG. 7 illustrates a variant of execution of the crank drive.

The elastic or self adjusting drive may be slightly different from the one described in FIGS. 1 and 4. FIG. 7 shows a variant of execution in which the radial component of the force and the adjustment are achieved by means of an elastic section 5*a* of the shaft 5 in form of a blade-like thin section over a roll 71. Correspondingly, in greater pumps, a radial pressure spring acting on a driver could be foreseen.

The illustrated and above described form of the displacement vanes and chambers is based on an isoceles triangle. Correspondingly, this form could be based on another polygon having an odd number of sides, e.g. a pentagon and finally also a circular form.

The illustrated essentially triangular or heart-shaped configuration offers the best conditions for an optimum economy of space. In each case the following conditions must be fulfilled.

In no place must exist a free passage between inlet and outlet, that is in order to a void a backflow of the medium in the inner and the outer displacement space, at least two lines of tight contact must be present for each chamber in the axial direction (FIG. 2).

These lines of tight contact coincide with the common tangents at the displacement vanes and chambers.

With many chambers in the same body, all of these must correspond to the tangents going through the lines of contact.

The relative direction of motion between the two parts must execute at least one complete turn of 360° with these tangents.

The section of the piston which is determinant for the quantity conveyed is the product of the width of the piston as seen through the respective distance of these tangents and the constant depth of immersion of the displacement vane in the displacement chamber. The respective stroke of the piston corresponds to the product of the angle of rotation and the eccentricity, that is $re \times 2\pi$ per turn.

For a uniform, circular relative motion of both parts, a variation (pulsation) of the conveyance is given only through the different distance between the respective tangents.

The form of the displacement chamber depends on the form of the displacement vane and of the radius of the eccentric drive.

If many displacement chambers are provided they may be connected in parallel as described above when relatively few conveying pressure for greater quantities conveyed is desired as for example in the case of a circulation pump. If higher pressures and smaller quantities conveyed are desired, each two chambers crosswise or all four chambers can be connected in series.

While in the illustrated example of execution, the pressure in the intermediate chamber acts only on the support 9, it would be possible in a corresponding variant to cause this pressure to act on the support 12 or inversed on both supports.

Figure 8:
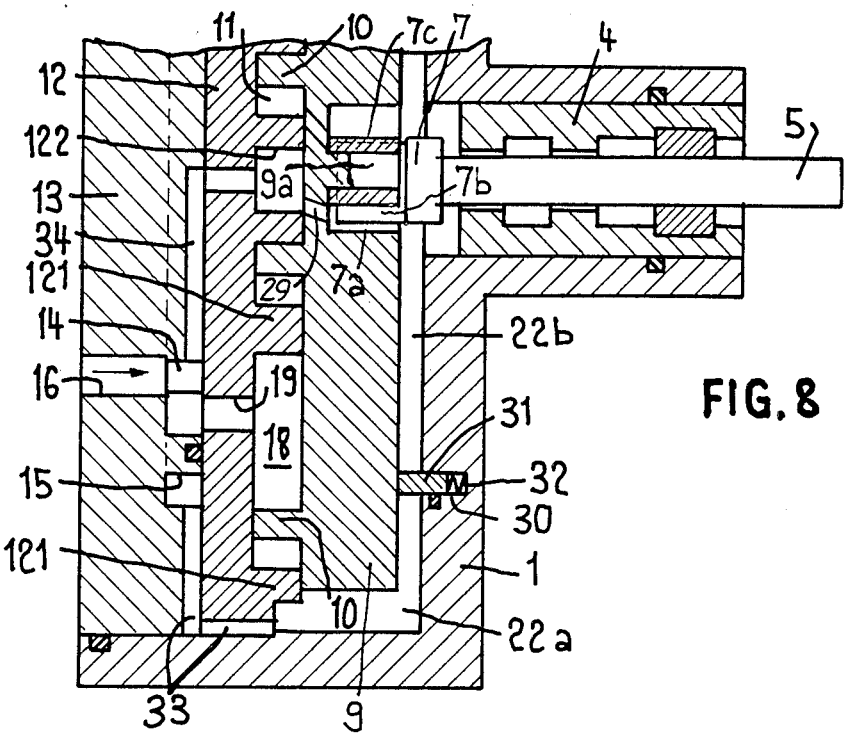
FIGS. 8 and 9 illustrate variants of execution of the pump.

It is also possible to cause the full pressure of the pump to act on an adequately dimensioned part of the surface of the support 9, instead to cause a partial pressure which corresponds to the average between the pressure at the inlet and outlet of the pump to act on the full surface of the support 9. A corresponding variant of execution is illustrated in FIG. 8. This variant corresponds to the lower part of FIG. 1 and the same reference numerals are utilized. A packing ring 31 is inserted in a circular groove 30 of the bearing flange 2. It is pressed against the outer side of the support 9 by means of a spring 32 inserted in the circular groove 30 or by many individual springs distributed at the periphery of the groove. The pressure exerted by the spring or the springs 32 corresponds to the one provided by the springs 21 in FIG. 1 through which the support 9 is pressed against the support 12 when the pump is stopped and without pressure. The packing ring divides the intermediate chamber 22 into an outer pressure chamber 22*a* and an inner pressure chamber 22*b*. The outer pressure chamber 22*a* is connected by a channel 33 with the circular channel 15 in which the pressure of the pump is present. The inner chamber 22*b* is connected through the opening 29 and a channel 34 with the inlet 16 of the pump. Therefore, during operation of the pump, practically the full pressure of the pump is present in the pressure chamber 22*a*, this pressure of the pump acting outside of the packing ring 31 on the circular surface of the support 9 and causing an optimum dimensioned pressure of this support against the support 12. On the contrary, the inner chamber 22*b* is pressureless because of its connection with the inlet of the pump so that in the domain of the inner chamber 22*b*, no pressure acts on the support 9. As indicated, the packing ring 31 may be tight in the groove 30 whereby a joint tight on both sides is also possible.

Figure 9:
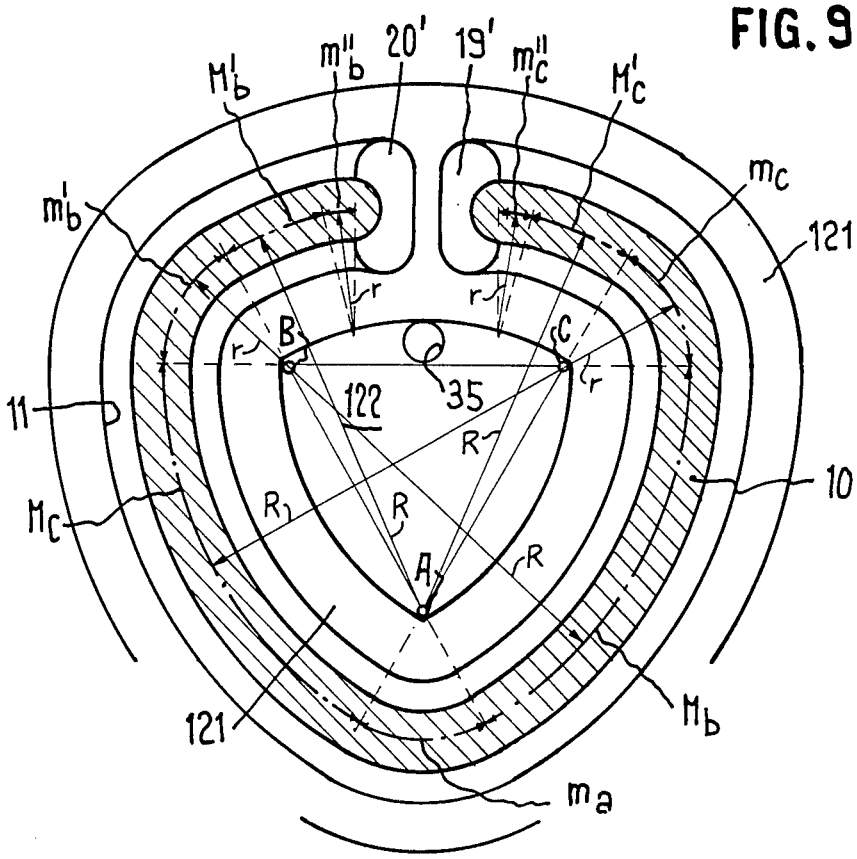

FIG. 9 corresponds to FIG. 3 and shows a variant of execution of the configuration of the displacement vanes 10 and the displacement chambers 11. While in accordance with FIG. 3 the end sections mb and mc comprise continuously the small radius of curvature r, these end sections according to FIG. 9 are each divided into a part mb', and mc' extending upon 60° with a radius of curvature r, a center part Mb', Mc' with a radius of curvature R and a short end section mb'' and mc'' with a radius of curvature r. The end of the displacement chambers 11 are nearer from each other and they open directly in elongated inlet and outlet openings 19' and 20'. The execution according to FIG. 9 permits to achieve a still smaller pulsation than the execution according to FIG. 3. As shown in FIG. 9, the displacement chamber 11 is encircled at the inside by a rib 121 the width of which, in correspondence with the above mentioned rule, is smaller than the double eccentric stroke re and, inside of this rib, is a flat recess 122 in the domain of which an opening 35 is present which is connected with the suction side or pressure side of the pump, also possibly connected with one of the opening 19' or with one circular channel connecting the openings 20' similarly to the channels 14 and 15.

As mentioned in the introduction, the supports 9 and 12 have a tendency to stick together and then to break loose suddenly. FIG. 2 shows a possible measure which can be taken to avoid this disadvantage. Closed, triangular recesses 124 are formed by means of outer ribs 123 extending along the periphery, together with the limiting ribs 121. When the pump is operating, a certain intermediate pressure builds up in these recesses between the supports 9 and 12 whereby this pressure may be determined as the case may be by means of discharging passages with a definite flow resistance. The bolsters of liquid in the recesses 124 prevent effectively instabilities of the kind mentioned and they contribute significantly to a quiet working of the machine.

The drive may also be so designed that a roll corresponding to the roll 71 according to FIG. 7 is mounted on a rigid eccentric of the driving shaft and acts on a cylindrical catch of the support 9 whereby the eccentricity of the motion of the roll is greater than the radius of the cylindrical relative motion of the support 9. Such a drive is simple and effective but it has some drawbacks with respect to the drive according to FIG. 1.

More particularly in a form of execution according to FIG. 9, problems may arise with respect to the connections of the inlet and outlet channels 19 and 20 to radially displaced circular channels 14, and 15. It would be possible in this case to orientate all chambers and displacement vanes by rotation of 120° with respect to the illustrated position in order that the ends of each chamber, and the channels 19 and 20 lie principally radially displaced.

The inlet and/or outlet channels could also traverse the support 9, particularly in a form of execution according to FIG. 8. In this case, the outlet channels could open at the inside of the packing 31 in the space **22*b* in which the full operating pressure would develop while the inlet channels or suction channels would be connected with the pressureless space 22*a* at the outside of the packing 31. In this case, the conveyed medium could be eliminated axially from the space 22*b*** by means of an in-line-motor and it would serve to the lubrication of the bearing and for cooling.

I claim:

1. A positive displacement pump, comprising;

a first support member having mounted thereon a plurality of displacement chambers;

a second support member having mounted thereon a plurality of displacement vanes, each of said displacement vanes being associated with a corresponding one of said displacement chambers, a plurality of inlet and outlet channels for directing a fluid medium into and out of said displacement chambers, a common central drive operable to transmit a driving force having radial and tangential components to one of said first support or said second support, for producing relative circular motion between said displacement chambers and associated displacement vanes, said displacement chambers and displacement vanes being radially spaced from said drive and having inner and outer surface respectively in proximate adjacent relationship;

said outer surface defining a path about said inner surface wherein said outer surface encompasses said inner surface substantially 360° therearound, and said inner surface defines a path substantially coextensive with and adjacent to said outer surface path; and wherein said inner and outer surfaces are essentially continuously curved, defining shapes which generally continuously widen in the direction radially outwardly from said central drive.

2. The pump of claim 1, said central drive further comprising:

a drive shaft;

a bushing, operatively connected to one of said first support or said second support; and catch means having a catching surface secured to said drive shaft for engaging said bushing; said catching surface being inclined with respect to a radial direction relative to said drive shaft.

3. The pump of claim 2, wherein said bushing includes a support surface configured for operative engagement with said catching surface.

4. The pump of claim 1, wherein said central drive is elastically, self-adjustingly attached to one of said first support or said second support.

5. The pump of claim 1, wherein said displacement chambers have a generally heart shaped configuration, and said inlet and outlet channels are positioned proximate the larger end of said heart shape.

6. The pump of claim 5, wherein said displacement chambers are disposed along an essentially circular border surrounding said central drive, and are arranged so that said larger ends of said heart shaped chambers are proximate the outer periphery of said circular border.

7. The pump of claim 6, wherein said displacement chambers and vanes are curved in configuration, the sides of said displacement chambers and vanes being composed of arcs of circles which grade into one another with continuity, the centers of curvature of said arcs being on an odd number of edges of regular polygons, the arcs of circles of greater and smaller radius of curvature alternately following each other.

8. The pump of claim 7, wherein said regular polygons are essentially triangular.

9. The pump of claim 1, further comprising:

rib members attached to said first support, wherein said ribs extending from said first support so as to limit the relative motion of said displacement chambers.

10. The pump of claim 9, wherein a portion of said ribs encircle said displacement vanes and said displacement chambers, said encircling ribs being convex shaped.

11. The pump of claim 9, wherein both said first support and said second support are comprised of materials having similar coefficients of expansion for moisture and temperature and similar abrasion properties.

12. The pump of claim 1, wherein said displacement chambers have indentations in said first support and said displacement vanes have ribs extending from a surface of said second support; said first support and said second support being positioned in opposing, abutting relationship whereby said displacement vanes are engaged in said displacement chambers.

13. The pump of claim 12 wherein at least one of said first and second supports is enclosed within an intermediate chamber in fluid communication with an interface between said opposing, abutting supports whereby an intermediate pressure is maintained within said intermediate chamber, said intermediate pressure being supported by fluid leakage from said interface, and being operable to maintain said first and second supports in said opposing abutting relationship.

14. The pump of claim 13, further comprising a backflow channel connecting said intermediate chamber with a low pressure side of said pump, said backflow channel having a predetermined fluid flow resistance.

15. The pump of claim 13, wherein said channel flow resistance is a function of the magnitude of said relative circular motion between said supports.

16. The pump of claim 13, wherein the cross section of said backflow channel is dimensioned to provide a fluidic resistance for optimum pumping efficiency by balancing the magnitude of the intermediate pressure with the magnitude of the pressure in said displacement chambers.

17. The pump of claim 13, further comprising:

a packing ring means for biasing said packing ring into operative engagement with one of said first and second supports to selectively block said fluid communication to thereby regulate said pressure in said intermediate chamber.

18. The pump of claim 1, further comprising biasing means for maintaining said displacement chambers and said displacement vanes in close operative engagement, said biasing means acting on at least one of said first and second supports.

19. The pump of claim 1, wherein said first and second support members lie in abutting relationship, and further comprising boxes formed in the lateral faces of said displacement chambers and vanes for forming stabilizing bolsters of conveyed medium.

20. A pump according to claim 1, characterized in that said drive is a roll which lies on a cylindrical catching surface of said one support, the eccentricity of the motion of the roll being greater than the radius of the cyclical relative motion.

21. A pump according to claim 1, characterized in that the force is produced by a flat, elastic part (5*a*) of the shaft (5) of the drive.

* * * * *